United States Patent [19]

McCasland et al.

[11] Patent Number: 4,932,832

[45] Date of Patent: Jun. 12, 1990

[54] BACKHOE GRIPPING ATTACHMENT

[76] Inventors: Thomas A. McCasland, 8218 S. Danks Dr., Evergreen, Colo. 80439; Gilbert L. Dunn, Jr., 2115 Allison St., Lakewood, Colo. 80215

[21] Appl. No.: 303,740

[22] Filed: Jan. 30, 1989

[51] Int. Cl.[5] ..... B66C 3/04; B66F 9/00

[52] U.S. Cl. ..... 414/732; 414/722; 414/729

[58] Field of Search ..... 414/729, 731, 732, 722, 414/723, 912, 694

[56] References Cited

U.S. PATENT DOCUMENTS

| | | | |
|---|---|---|---|
| 3,422,975 | 1/1969 | Crisp | 414/732 |
| 4,017,114 | 4/1977 | LaBounty | 414/732 |
| 4,375,345 | 3/1983 | Hanson | 414/722 |
| 4,407,626 | 10/1983 | Bruckner | 414/722 |
| 4,761,113 | 8/1988 | Smith et al. | 414/723 |
| 4,804,309 | 2/1989 | Risch | 414/723 |
| 4,820,112 | 4/1989 | Mullican | 414/912 |

FOREIGN PATENT DOCUMENTS

| | | | |
|---|---|---|---|
| 1514412 | 1/1967 | France | 414/722 |

*Primary Examiner*—David H. Brown

[57] ABSTRACT

An auxiliary device to be mounted on a backhoe to allow gripping and lifting of objects. The device requires no additional power or operation control devices to function. The device is comprised of an opposing structure, along with appropriate linkages, which along with the bucket on the equipment is used as a gripping, crushing, or holding device.

3 Claims, 2 Drawing Sheets

3
9
6
4
1
8
7
12
2
5
10
111

3
9
6
4
1
8
7
12
2
105
10
11

BACKHOE GRIPPING ATTACHMENT

BACKGROUND OF THE INVENTION

1. Field of the Invention

The invention relates generally to a device for gripping objects using a backhoe without additional powered hydraulic cylinders or controls.

2. Description of the Prior Art

Backhoes are designed primarily for digging. Many times it is necessary to grip and lift an object such as a rock, pipe, or concrete slab. Attempts to remove such objects from a hole usually result in the object being pulled under the equipment, requiring manual removal of the object. Devices have been built utilizing a separate holding structure, that require a separate additional hydraulic cylinder and its associated controls. This invention eliminates the need for additional cylinders and controls for gripping and lifting objects.

SUMMARY OF THE INVENTION

The invention relates to a device to allow a backhoe to grip and lift objects. It comprises a means for attaching the invention to a backhoe assembly.

It is an object of the invention to provide an inexpensive device which will allow more efficient use of a backhoe, which will increase productivity.

DESCRIPTION OF THE PREFERRED EMBODIMENT

Figure 1:
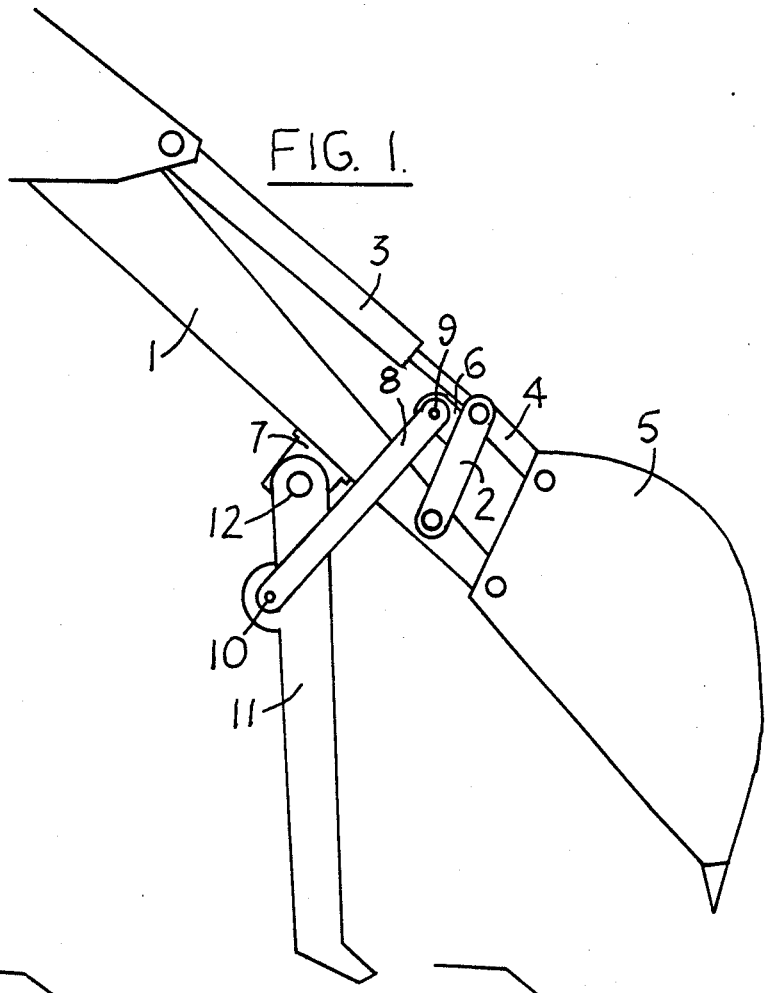
FIG. 1 is a plan view showing an embodiment of the backhoe gripping attachment.
Figure 2:
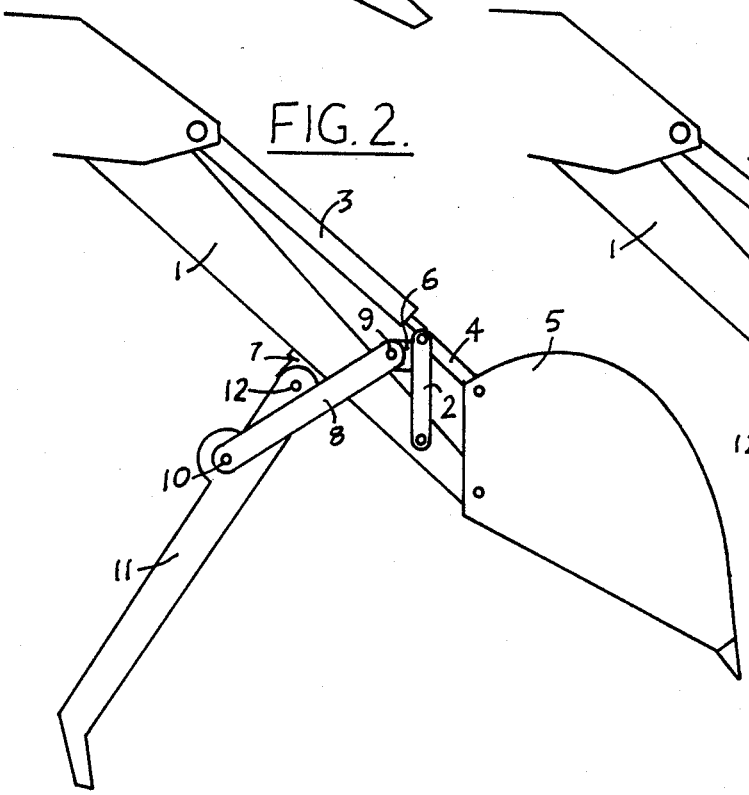
FIG. 2 is a plan view showing an embodiment of the backhoe gripping attachment in the fully open position.
Figure 3:
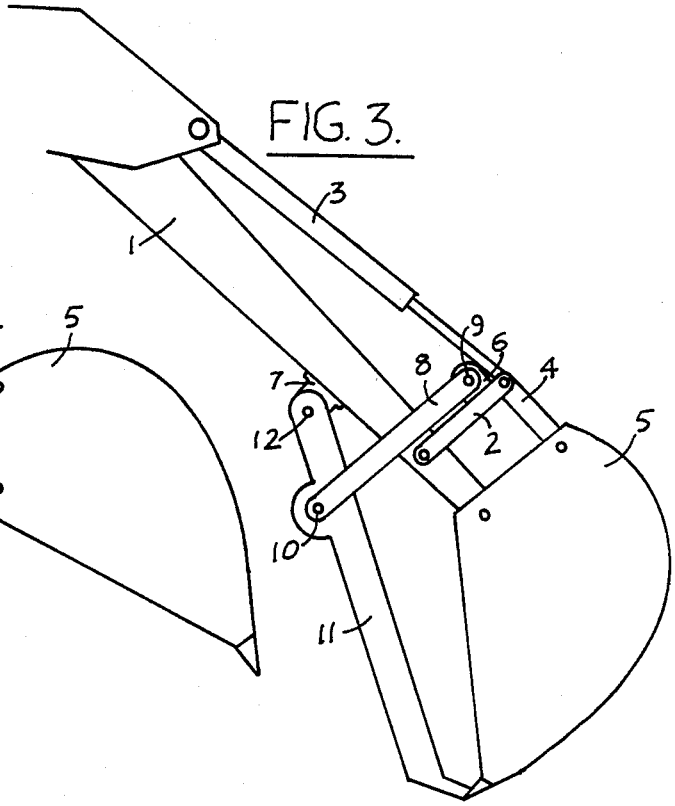
FIG. 3 is a plan view showing an embodiment of the backhoe gripping attachment in the fully closed position.

Referring to FIGS. 1, 2, and 3 an embodiment of the invention is shown in which the backhoe gripping attachment is attached to the arm 1 and cylinder linkage 2 of a backhoe. Other parts of a backhoe include a cylinder 3, a bucket linkage arm 4, and a bucket 5.

In this embodiment, hinge plate 6 is connected to cylinder linkage 2, and hinge member 7 is connected to arm 1, for example, by welding.

Structure 11 is connected to hinge bracket 7 by means of hinge pin 12. Actuating member 8 is connected to hinge plate 6 by hinge pin 9 and to structure 11 by hinge pin 10.

Referring to FIG. 2, the normal retraction of cylinder 3 causes bucket 5 to rotate around arm 1, causing structure 11 to rotate away from arm 1 due to the movement of actuating member 8.

Referring to FIG. 3, extension of cylinder 3 causes the reverse action shown in FIG. 2. The tangential force applied by cylinder 3 on actuating member 8 through cylinder linkage 2, and hinge plate 6 and bucket linkage member 4 causes maximum pressure to be exerted between structure 11 and bucket 5 in the closed position for crushing applications.

Figure 4:
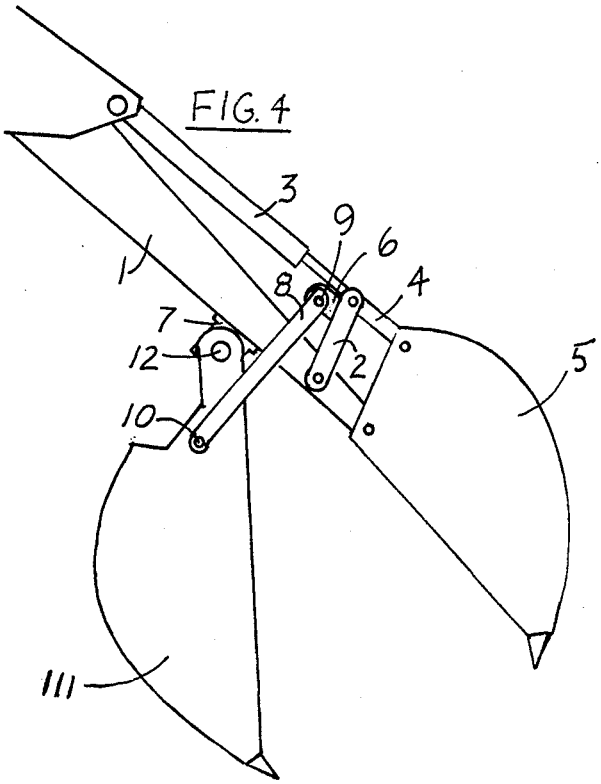
FIG. 4 is a plan view of a first modification of the structure shown in open position.
Figure 5:
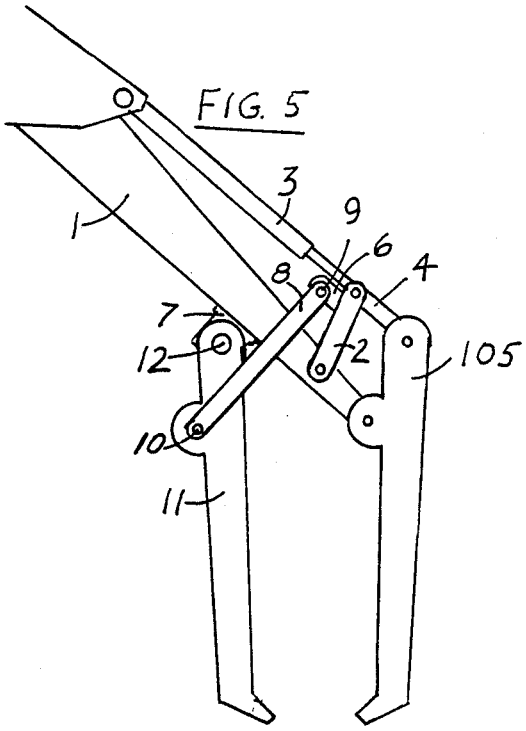
FIG. 5 is a plan view of a second modification of the structure shown in partially closed position.

Although one detailed embodiment of the invention is illustrated in the drawings and previously described in detail, the invention contemplates any configuration and design of components which will accomplish the equivalent result. As an example, the invention can be manufactured with a duplicate or linkage arm 8 and hinge plate 6 on the opposite side of arm 1 for increased strength. In another example hinge plate 6 and cylinder linkage member 2 can be manufactured as one piece. In another example, structure 11 could be replaced with a bucket 111 similar to bucket 5 to provide a clam shell type digging device as in FIG. 4. As a further example bucket 5 could be replaced with device 105 similar to structure 11 to allow the invention to be used for specialized gripping and lifting applications as in FIG. 5.

We claim:

1. A detachable backhoe gripping attachment for use with a conventional backhoe bucket and boom arm having a first pivot means connecting a lower end of the bucket to the boom arm, a second pivot means and first link means connecting an upper end of the bucket to a single hydraulic cylinder means, and a second link means pivotally connecting the first link means, cylinder means and boom arm to each other, the improvement comprising:

a hinge plate mounted on the second link means, a hinge member mounted on the boom arm, an elongated gripping means pivotally connected at one end to said hinge member, and an elongated actuating member pivotally connected at its ends respectively to said hinge plate and to an intermediate point along said gripping means, wherein actuation of said single hydraulic cylinder means causes opposite pivotal movement of said bucket and said gripping means toward and away from each other.

2. A detachable backhoe gripping attachment as recited in claim 1, wherein said elongated gripping means is replaced with a second bucket means and similarly connected to said boom arm and hinge member for opposed rotational movement relative to said conventional backhoe bucket.

3. A detachable backhoe gripping attachment as recited in claim 1, wherein said conventional backhoe bucket is replaced with a second elongated gripping means and similarly connected to said boom arm and first link means for opposed rotational movement relative to said first elongated gripping means.

* * * * *